US010365581B1

(12) United States Patent
Hamakawa et al.

(10) Patent No.: US 10,365,581 B1
(45) Date of Patent: Jul. 30, 2019

(54) DEVELOPING DEVICE AND IMAGE FORMING APPARATUS INCLUDING SAME

(71) Applicant: KYOCERA Document Solutions Inc., Osaka (JP)

(72) Inventors: Hiroyuki Hamakawa, Osaka (JP); Kenichi Tamaki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/207,961

(22) Filed: Dec. 3, 2018

(30) Foreign Application Priority Data

Jan. 24, 2018 (JP) ..... 2018-009652
Jan. 24, 2018 (JP) ..... 2018-009653

(51) Int. Cl.
*G03G 15/09* (2006.01)
*G03G 15/08* (2006.01)
*G03G 21/10* (2006.01)

(52) U.S. Cl.
CPC ..... *G03G 15/0812* (2013.01); *G03G 15/0898* (2013.01); *G03G 21/105* (2013.01)

(58) Field of Classification Search
CPC ..... G03G 15/0812; G03G 15/0898; G03G 15/0889; G03G 15/0891; G03G 15/0886; G03G 21/105
See application file for complete search history.

(56) References Cited

U.S. PATENT DOCUMENTS 9,323,180 B2 * 4/2016 Kashimoto ..... G03G 15/0889
2012/0201575 A1 * 8/2012 Kashimoto ..... G03G 15/0812 399/272

FOREIGN PATENT DOCUMENTS

JP 2012-208469 A 10/2012

* cited by examiner

*Primary Examiner* — Hoang X Ngo
(74) *Attorney, Agent, or Firm* — Stein IP, LLC

(57) ABSTRACT

A developing device includes a developing container, a first stirring and conveying member, a second stirring and conveying member, a developer replenishing port, a developer discharging portion, a developing roller, a toner supply roller, a regulating blade, a toner receiver member, and a vibration generating device. The developing device is capable of executing a toner collecting mode in which the vibration generating device vibrates the toner receiver member so that toner deposited on the toner receiver member is shaken off by vibration and is collected into the second conveying chamber, in the non-image formation period. The developing device is capable of executing a forced discharge mode in which developer containing the collected toner collected from the toner receiver member into the second conveying chamber is forcibly discharged from the developer discharging portion to outside of the developing container, after the toner collecting mode is executed.

13 Claims, 13 Drawing Sheets

DEVELOPING DEVICE AND IMAGE FORMING APPARATUS INCLUDING SAME

INCORPORATION BY REFERENCE

This application is based upon and claims the benefit of priority from the corresponding Japanese Patent Application Nos. 2018-009652 and 2018-009653 filed Jan. 24, 2018, the entire contents of which are hereby incorporated by reference.

BACKGROUND

The present disclosure relates to a developing device that supplies developer to an image carrier, and relates to an electrophotographic image forming apparatus including the developing device.

The electrophotographic image forming apparatus irradiates a circumferential surface of the image carrier (photosensitive drum) with light based on image information read from a document image or image information transmitted from an external device such as a computer, so as to form an electrostatic latent image. This electrostatic latent image is supplied with toner from the developing device so that a toner image is formed, and then this toner image is transferred onto a paper sheet. The paper sheet with the transferred image undergoes a process for fixing the toner image and is discharged to outside.

In recent years, along with the progress of color printing and fast processing, the structure of the image forming apparatus has become complicated, and fast rotation of a toner stirring member in the developing device is inevitable to support the fast processing. Particularly in a development system, which uses two-component developer containing magnetic carrier and toner, a magnetic roller (toner supply roller) that carries the developer, and a developing roller that carries only toner, only toner is carried on the developing roller with a magnetic brush formed on the magnetic roller at the part where the developing roller and the magnetic roller face each other, and further, toner that was not consumed for developing is removed from the developing roller. For this reason, scattering of toner easily occurs at the part where the developing roller and the magnetic roller face each other, and toner floating in the developing device deposits in the periphery of an ear-breaking blade (regulating blade). If the deposited toner coagulates and adheres to the developing roller, toner dropping may occur resulting in an image malfunction.

Accordingly, for example, there is known a developing device, which uses the two-component developer containing magnetic carrier and toner, the magnetic roller that carries the developer, and the developing roller that carries only toner, and includes a toner receiver support member that faces the developing roller or the magnetic roller, a toner receiver member disposed along a longitudinal direction of the toner receiver support member so as to receive toner dropped from the developing roller, and a vibration generating unit that vibrates the toner receiver member.

With the structure described above, toner deposited on the toner receiver member is shaken off by vibration, and hence it is possible to prevent toner deposition in the periphery of the regulating blade in the casing of the developing device and occurrence of toner dropping due to the toner deposition.

SUMMARY

A developing device according to an aspect of the present disclosure includes a developing container, a first stirring and conveying member, a second stirring and conveying member, a developer replenishing port, a developer discharging portion, a developing roller, a toner supply roller, a regulating blade, a toner receiver member, and a vibration generating device. The developing container includes a first conveying chamber, a second conveying chamber disposed in parallel to the first conveying chamber with a partition portion therebetween, communicating portions that communicate the first conveying chamber and the second conveying chamber at both end portion sides of the partition portion in its longitudinal direction, and the developing container stores two-component developer containing carrier and toner. The first stirring and conveying member stirs and conveys the developer in the first conveying chamber in its rotation shaft direction. The second stirring and conveying member stirs and conveys the developer in the second conveying chamber in a direction opposite to the first stirring and conveying member. The developer replenishing port replenishes the developing container with the developer. The developer discharging portion discharges excess developer from the developing container. The developing roller, which is supported by the developing container in a rotatable manner, supplies toner to an image carrier on which an electrostatic latent image is formed, in an opposed region between the developing roller and the image carrier. The toner supply roller, which is supported by the developing container in a rotatable manner, carries the developer in the second conveying chamber on its surface and supplies the toner to the developing roller in an opposed region between the developing roller and the developing roller. The regulating blade is disposed to face the toner supply roller with a predetermined space therebetween. The toner receiver member is disposed to face the developing roller or the toner supply roller between the regulating blade and the image carrier in the developing container, so as to receive toner dropped from the developing roller. The vibration generating device vibrates the toner receiver member. The developing device can execute a toner collecting mode in which the vibration generating device vibrates the toner receiver member so that the toner deposited on the toner receiver member is shaken off by vibration and is collected into the second conveying chamber, in a non-image formation period. After the toner collecting mode is executed, the developing device can execute a forced discharge mode in which the developer containing the collected toner collected from toner receiver member into the second conveying chamber is forcibly discharged from the developer discharging portion to outside of the developing container.

Other objects of the present disclosure and specific advantages obtained by the present disclosure will become more apparent from the description of embodiments given below.

DETAILED DESCRIPTION

Figure 1:
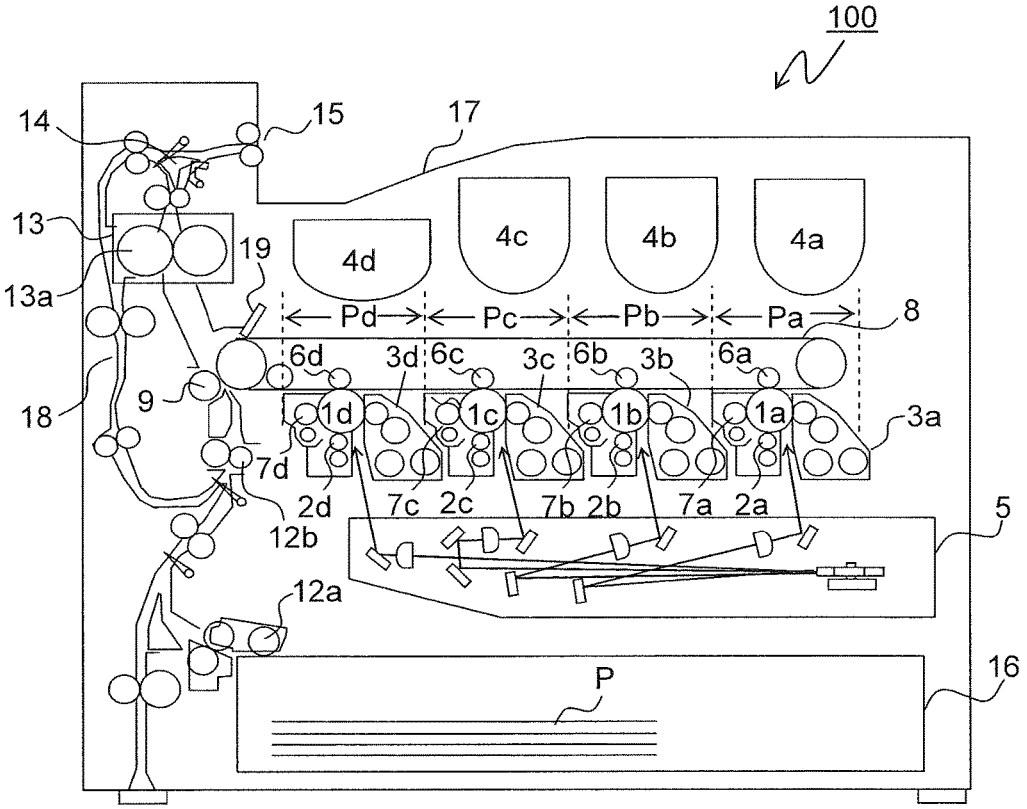
FIG. 1 is a schematic structural diagram of a color printer in which a developing device according to the present disclosure is mounted.

Now, embodiments of the present disclosure are described below with reference to the drawings. FIG. 1 is a schematic cross-sectional view of an image forming apparatus equipped with a developing device according to the present disclosure, and it illustrates a tandem type color printer. A color printer 100 has a main body in which four image forming portions Pa, Pb, Pc and Pd are disposed in order from an upstream side in a conveying direction (the right side in FIG. 1). These image forming portions Pa to Pd are disposed corresponding to four different color images (cyan, magenta, yellow, and black images), so as to sequentially form cyan, magenta, yellow, and black images by processes of electrification, exposure, development, and transfer.

These image forming portions Pa to Pd are respectively provided with photosensitive drums 1*a*, 1*b*, 1*c* and 1*d* carrying corresponding color visual images (toner images), and an intermediate transfer belt 8 that turns in a clockwise direction in FIG. 1 is disposed adjacent to the image forming portions Pa to Pd.

When image data is input from a host device such as a personal computer, charging devices 2*a* to 2*d* first charge surfaces of the photosensitive drums 1*a* to 1*d* uniformly. Next, an exposing device 5 emits light corresponding to the image data so as to form electrostatic latent images corresponding to the image data on the photosensitive drums 1*a* to 1*d*. Developing devices 3*a* to 3*d* are supplied with predetermined amounts of two-component developers containing cyan, magenta, yellow, and black color toners from toner containers 4*a* to 4*d*, respectively. The developing devices 3*a* to 3*d* supply the toners in the developers onto the photosensitive drums 1*a* to 1*d* so that the toners adhere to them in an electrostatic manner. In this way, the toner images are formed corresponding to the electrostatic latent images formed by exposure by the exposing device 5.

Then, primary transfer rollers 6*a* to 6*d* apply electric fields with predetermined transfer voltages between the primary transfer rollers 6*a* to 6*d* and the photosensitive drums 1*a* to 1*d*, respectively, so that the cyan, magenta, yellow, and black toner images on the photosensitive drums 1*a* to 1*d* are primarily transferred onto the intermediate transfer belt 8. After the primary transfer, toners and the like remaining on the surfaces of the photosensitive drums 1*a* to 1*d* are removed by cleaning devices 7*a* to 7*d*.

Paper sheets P onto which the toner images will be transferred are stored in a paper sheet cassette 16 disposed in a lower part of the image forming apparatus 100. The paper sheet P is conveyed by a sheet feed roller 12*a* and a registration roller pair 12*b* to a nip portion (secondary transfer nip portion) between the intermediate transfer belt 8 and a secondary transfer roller 9 disposed adjacent to the intermediate transfer belt 8, at a predetermined timing. The paper sheet P, to which the toner image is secondarily transferred, is conveyed to a fixing portion 13. In addition, on the downstream side of the secondary transfer roller 9, there is disposed a blade-like belt cleaner 19 for removing toner remaining on the surface of the intermediate transfer belt 8.

The paper sheet P conveyed to the fixing portion 13 is heated and pressed by a fixing roller pair 13*a* so that the toner image is fixed on the surface of the paper sheet P and that a predetermined full color image is formed. The paper sheet P with the formed full color image is discharged by a discharge roller pair 15 onto a discharge tray 17 as it is (or after being distributed to a reverse conveying path 18 by a branching portion 14 and after images are formed on both sides).

Figure 2:
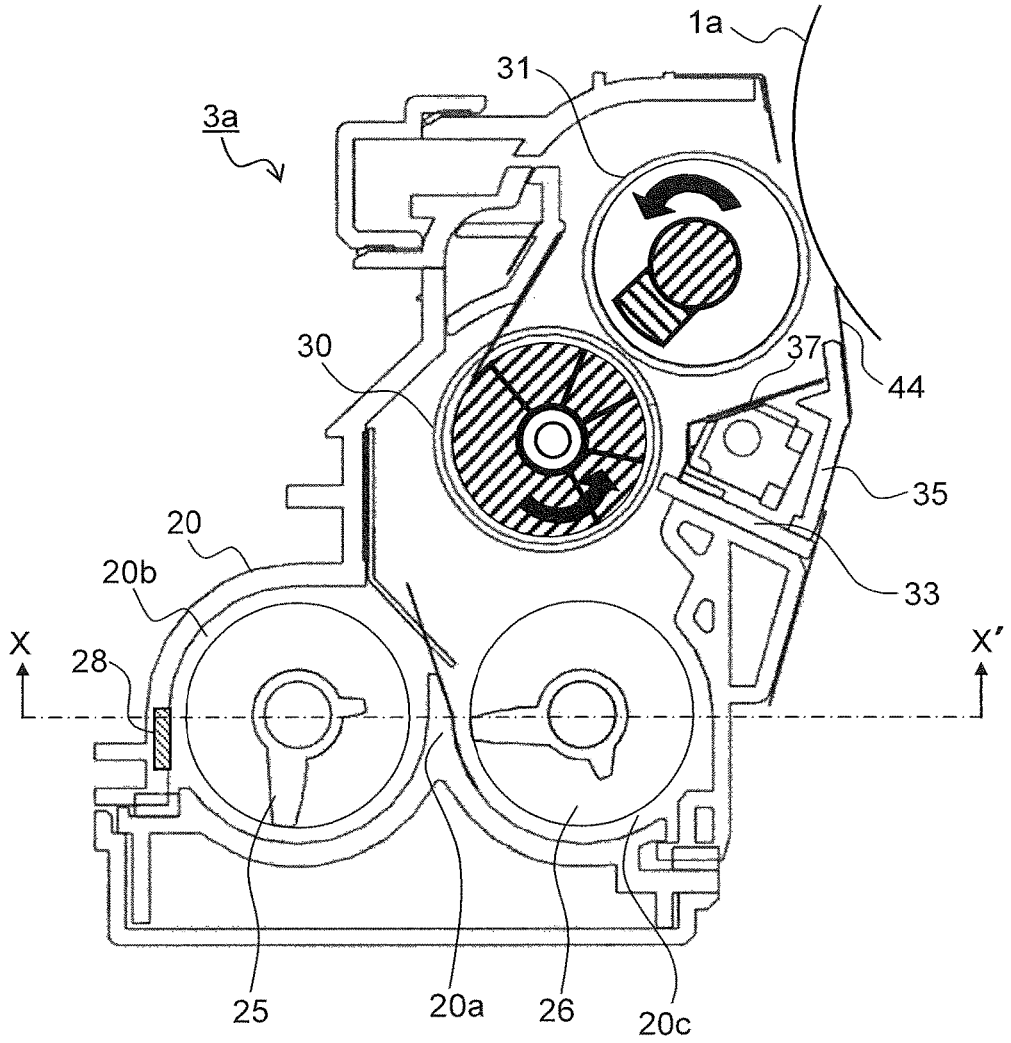
FIG. 2 is a cross-sectional side view of the developing device according to a first embodiment of the present disclosure.

FIG. 2 is a cross-sectional side view of the developing device 3*a* according to a first embodiment of the present disclosure, which is mounted in the color printer 100. Note that FIG. 2 illustrates a state viewed from rear in FIG. 1, and so members in the developing device 3*a* are shown in an arrangement opposite to that in FIG. 1 in the left and right direction. In addition, in the following description, the developing device 3*a* in the image forming portion Pa illustrated in FIG. 1 is exemplified, but other developing devices 3*b* to 3*d* disposed in the image forming portions Pb to Pd have the same basic structure, and therefore descriptions thereof are omitted.

As illustrated in FIG. 2, the developing device 3*a* includes a developing container (casing) 20 that stores two-component developer containing toner and magnetic carrier (hereinafter simply referred to as developer). The developing container 20 is divided into a stirring and conveying chamber 20*b* (first conveying chamber) and a feed conveying chamber 20*c* (second conveying chamber) with a partition wall 20*a* therebetween. The stirring and conveying chamber

20*b* and the feed conveying chamber 20*c* respectively include a stirring and conveying screw 25 and a feed conveying screw 26 disposed in a rotatable manner, each of which mixes and stirs toner (positively charged toner) supplied from the toner container 4*a* (see FIG. 1) with carrier so as to charge them.

Then, the stirring and conveying screw 25 and the feed conveying screw 26 feed the developer in the axial direction (perpendicular to the paper in FIG. 2) while stirring the same. The developer circulates between the stirring and conveying chamber 20*b* and the feed conveying chamber 20*c* via communicating portions 20*d* and 20*e* formed on both end portions of the partition wall 20*a* (see FIG. 8). In other words, the stirring and conveying chamber 20*b*, the feed conveying chamber 20*c*, and the communicating portions 20*d* and 20*e* form a circulation path for the developer in the developing container 20.

The developing container 20 extends to the upper right in FIG. 2. In the developing container 20, a toner supply roller 30 is disposed above the feed conveying screw 26, while a developing roller 31 is disposed at the upper right of the toner supply roller 30 so as to face the same. Further, the developing roller 31 faces the photosensitive drum 1*a* on an opening side of the developing container 20 (on the right side in FIG. 2). The toner supply roller 30 and the developing roller 31 rotate in a counterclockwise direction in FIG. 2 about individual rotation shafts, respectively.

The stirring and conveying chamber 20*b* is provided with a toner concentration sensor 28 disposed to face the stirring and conveying screw 25. The toner concentration sensor 28 detects a ratio of the toner to the carrier (T/C) in the developer, and is, for example, a magnetic permeability sensor that detects a magnetic permeability of the developer in the developing container 20. In this embodiment, the toner concentration sensor 28 detects a magnetic permeability of the developer and outputs a voltage value corresponding to a result of the detection to a control unit 90 (see FIG. 17), so that toner concentration is determined based on the output value of the toner concentration sensor 28. The control unit 90 transmits a control signal to a developer replenishment motor (not shown) in accordance with the determined toner concentration, and hence the stirring and conveying chamber 20*b* is replenished with a predetermined amount of toner and carrier from the toner container 4*a* via a developer replenishing port 20*f* (see FIG. 8).

The toner supply roller 30 is constituted of a non-magnetic rotating sleeve that rotates in the counterclockwise direction in FIG. 2 and a fixed magnet body having a plurality of magnetic poles included in the rotating sleeve.

The developing roller 31 is constituted of a cylindrical developing sleeve that rotates in the counterclockwise direction in FIG. 2 and a developing roller side magnetic pole fixed in the developing sleeve. The toner supply roller 30 and the developing roller 31 face each other with a predetermined gap therebetween at a facing position (opposed position). The developing roller side magnetic pole has a polarity different from that of the opposed magnetic pole (main pole) of the fixed magnet body.

In addition, the developing container 20 is provided with an ear-breaking blade 33 attached along the longitudinal direction of the toner supply roller 30 (the direction perpendicular to the paper in FIG. 2). The ear-breaking blade 33 is disposed on the upstream side of the opposed position between the developing roller 31 and the toner supply roller 30 in the rotation direction of the toner supply roller 30 (the counterclockwise direction in FIG. 2). Further, a small clearance (gap) is formed between the tip end part of the ear-breaking blade 33 and the surface of the toner supply roller 30.

The developing roller 31 is applied with a DC voltage (hereinafter denoted by Vslv(DC)) and an AC voltage (hereinafter denoted by Vslv(AC)). The toner supply roller 30 is applied with a DC voltage (hereinafter denoted by Vmag (DC)) and an AC voltage (hereinafter denoted by Vmag (AC)). These DC voltages and the AC voltages are applied to the developing roller 31 and the toner supply roller 30 from a developing bias power supply via a bias control circuit (which are not shown).

As described above, the stirring and conveying screw 25 and the feed conveying screw 26 stir the developer, and the developer is circulated in the stirring and conveying chamber 20*b* and the feed conveying chamber 20*c* in the developing container 20, thereby the toner is electrified. The feed conveying screw 26 conveys the developer to the toner supply roller 30, and a magnetic brush (not shown) is formed on the toner supply roller 30. A layer thickness of the magnetic brush on the toner supply roller 30 is regulated by the ear-breaking blade 33, and the magnetic brush is conveyed to the opposed part between the toner supply roller 30 and the developing roller 31. Then, a potential difference ΔV between Vmag(DC) applied to the toner supply roller 30 and Vslv(DC) applied to the developing roller 31 and a magnetic field cause formation of a thin layer of toner on the developing roller 31.

A thickness of the toner layer on the developing roller 31 varies depending also on resistance of the developer or a difference in rotation speed between the toner feeding roller 30 and the developing roller 31, and the thickness can be controlled based on ΔV. The thickness of the toner layer on the developing roller 31 is increased when ΔV is increased, and it is decreased when ΔV is decreased. A range of ΔV in the developing process is preferably from 100 V to 350 V in general.

The thin layer of toner formed on the developing roller 31 due to contact with the magnetic brush on the toner supply roller 30 is conveyed to the opposed part (opposed region) between the photosensitive drum 1*a* and the developing roller 31 when the developing roller 31 rotates. The developing roller 31 is applied with Vslv(DC) and Vslv(AC), and the toner flies due to the potential difference between the developing roller 31 and the photosensitive drum 1*a*, so that the electrostatic latent image on the photosensitive drum 1*a* is developed.

Remaining toner that was not consumed for developing is reconveyed to the opposed part between the developing roller 31 and the toner supply roller 30 and is collected by the magnetic brush on the toner supply roller 30. Further, the magnetic brush is removed from the toner supply roller 30 at the same pole part of the fixed magnet body and then drops into the feed conveying chamber 20*c*.

After that, on the basis of a result of detection by the toner concentration sensor 28, a predetermined amount of developer is replenished from the developer replenishing port 20*f* (see FIG. 8), and hence the two-component developer that has appropriate toner concentration and is uniformly charged is made while it circulates in the feed conveying chamber 20*c* and the stirring and conveying chamber 20*b*. This developer is supplied again onto the toner supply roller 30 by the feed conveying screw 26 so that the magnetic brush is formed and is conveyed to the ear-breaking blade 33.

On the right side wall of the developing container 20 in FIG. 2, near the developing roller 31, there is disposed a toner receiver support member 35 having a triangular cross section protruding inward of the developing container 20. As illustrated in FIG. 2, the toner receiver support member 35 is disposed along the longitudinal direction of the developing container 20 (the direction perpendicular to the paper in FIG. 2). The upper surface of the toner receiver support member 35 forms a wall portion that faces the toner supply roller 30 and the developing roller 31 and is inclined downward from the developing roller 31 toward the toner supply roller 30. The upper surface of the toner receiver support member 35 is provided with a toner receiver member 37 attached along the longitudinal direction, which receives toner that is removed and dropped from the developing roller 31.

Figure 3:
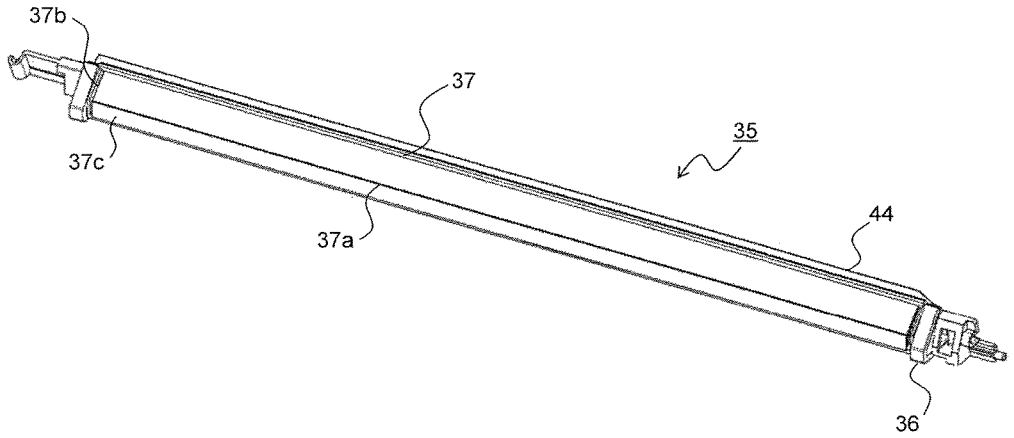
FIG. 3 is a perspective view of a toner receiver support member used in the developing device of the first embodiment, viewed from inside of the developing container.
Figure 4:
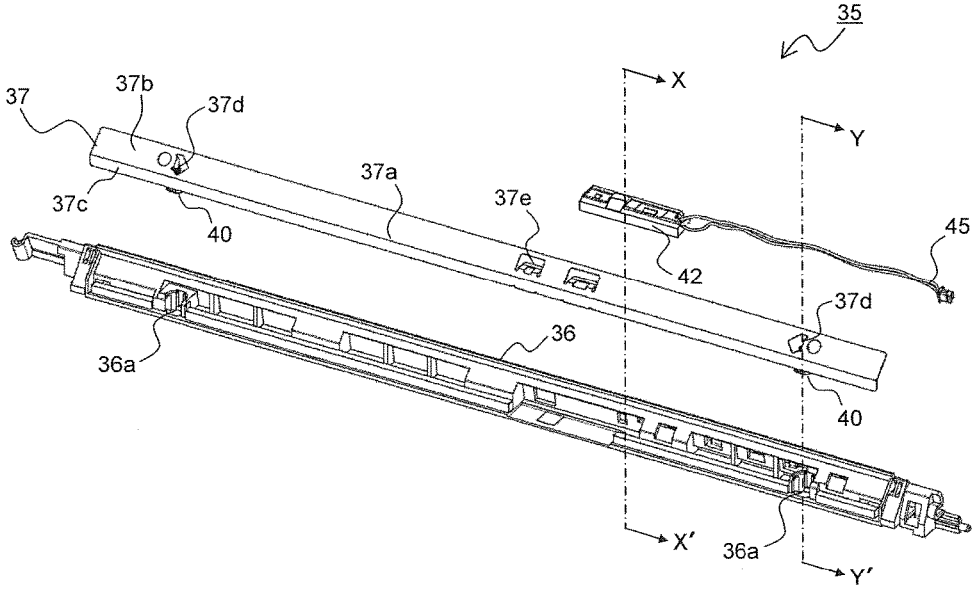
FIG. 4 is a perspective view of a toner receiver member constituting the toner receiver support member, viewed from backside.

FIG. 3 is a perspective view of the toner receiver support member 35 used in the developing device 3*a* of the first embodiment, viewed from inside of the developing container 20 (the left side in FIG. 2). FIG. 4 is an exploded perspective view of the toner receiver support member 35.

The toner receiver member 37 is made of metal sheet and has a bent shape with a bent portion 37*a* formed along the longitudinal direction. With respect to the bent portion 37*a*, the toner receiver member 37 is sectioned into a toner receiving surface 37*b* facing the developing roller 31 (see FIG. 2) and a toner dropping surface 37*c* facing the toner supply roller 30 to be substantially vertical. In addition, the toner receiver member 37 is supported by a resin support member main body 36 via two coil springs 40. Specifically, engaging portions 37*d* are formed by bending at two positions on both ends of the toner receiver member 37. One end of the coil spring 40 engages with the engaging portion 37*d*, and a spring pedestal 39 (see FIG. 7) is attached to the other end of the coil spring 40. The spring pedestal 39 is retained by a spring pedestal retaining portion 36*a* of the support member main body 36. In addition, a holder retaining portion 37*e* to support a vibration generating device 42 is formed by bending at a substantially middle portion of the toner receiver member 37.

In the vibration generating device 42, there are disposed a vibration motor 43 (see FIG. 5) and a printed circuit board (not shown) on which circuits and electronic components to control drive of the vibration motor 43 are mounted, and lead wires 45 to supply power to the vibration motor 43 are connected.

Sheet members 41*a* and 41*b* (see FIG. 6) are pasted on the surface of the toner receiver member 37. The sheet members 41*a* and 41*b* are made of a material that is less sticky to toner than the toner receiver member 37, in order to prevent toner from sticking to the toner receiver member 37. As the material of the sheet members 41*a* and 41*b*, there is fluorocarbon resin sheet or the like, for example.

The sheet member 41*a* is pasted to cover the surface of the toner receiver member 37 (toner dropping surface 37*c*) including a boundary between the support member main body 36 on the ear-breaking blade 33 side and the toner receiver member 37. In addition, the sheet member 41*b* is pasted to cover the entire region of the toner receiving surface 37*b* including a boundary between the support member main body 36 on a seal member 44 side and the toner receiver member 37, the engaging portion 37*d*, and the holder retaining portion 37*e*. The sheet members 41*a* and 41*b* prevent toner from sticking to the toner receiving surface 37*b* and the toner dropping surface 37*c*, and prevent toner from entering into the toner receiver support member 35 from the boundary between the support member main body 36 and the toner receiver member 37, and prevent operation malfunction of the vibration motor 43 due to the entering of toner.

In addition, an upper end of the support member main body 36 is provided with a film-like seal member 44. The seal member 44 extends in the longitudinal direction of the support member main body 36 (the left and right direction in FIG. 3) so that the tip end part thereof contacts with the surface of the photosensitive drum 1*a*, and it has a function of sealing the developing container 20 (see FIG. 2) so that toner in the same does not leak to outside.

Figure 5:
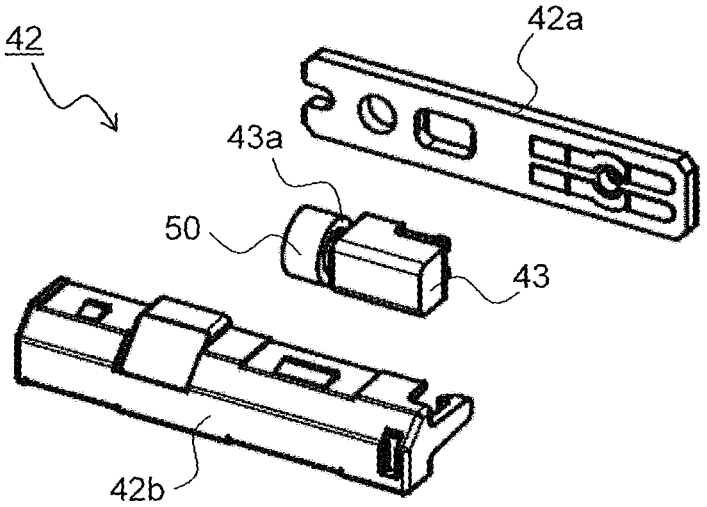
FIG. 5 is a perspective view illustrating an internal structure of a vibration generating device mounted on the toner receiver member.

FIG. 5 is an exploded perspective view of the vibration generating device 42 illustrated in FIG. 4. The vibration generating device 42 is constituted of the vibration motor 43, a motor mounting plate 42*a* to which the vibration motor 43 is fixed, and a cover member 42*b*. A vibration weight 50 is fixed to an output shaft 43*a* of the vibration motor 43. In addition, the vibration motor 43 is fixed so that its output shaft 43*a* is along the longitudinal direction of the toner receiver member 37.

The vibration weight 50 has a shape asymmetric with respect to the output shaft 43*a* of the vibration motor 43 (e.g. a cam shape). When the output shaft 43*a* rotates at a predetermined speed or faster, uneven centrifugal force is applied to the vibration weight 50. As this centrifugal force is transmitted to the output shaft 43*a*, the vibration motor 43 is vibrated. Note that a shape of the vibration weight 50 is not limited to the cam shape, but can be any shape whose center of gravity is deviated from the output shaft 43*a*.

Figure 6:
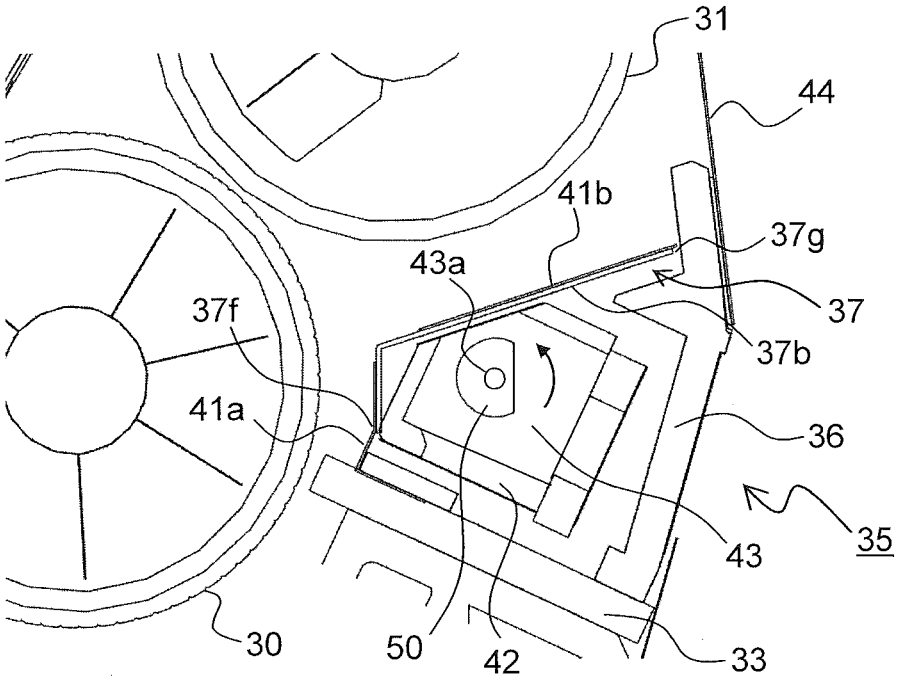
FIG. 6 is a cross-sectional side view of the toner receiver support member and its periphery of the developing device of the first embodiment, and is a diagram illustrating a cross section of a vibration motor and its vicinity.
Figure 7:
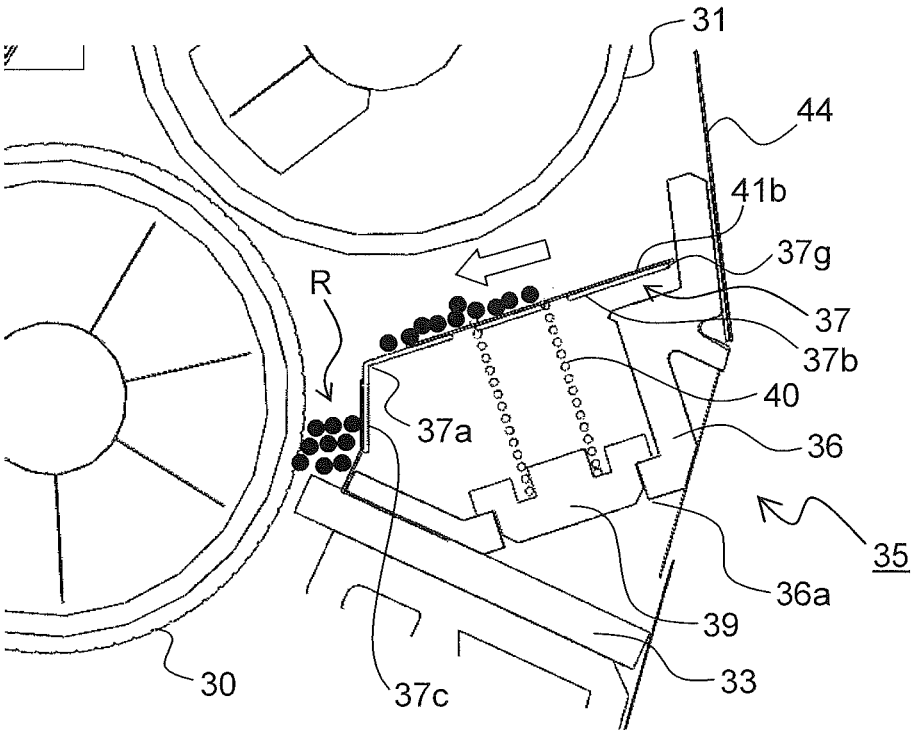
FIG. 7 is a cross-sectional side view of the toner receiver support member and its periphery of the developing device of the first embodiment, and is a diagram illustrating a cross section including a coil spring.

FIGS. 6 and 7 are cross-sectional side views illustrating internal structures of the toner receiver support member 35 used in the developing device 3*a* of the first embodiment. Note that FIG. 6 illustrates a cross section of the vibration motor 43 and its vicinity in the toner receiver support member 35 (XX' cross section in FIG. 4), and FIG. 7 illustrates a cross section including the coil spring 40 of the toner receiver support member 35 (YY' cross section in FIG. 4).

The toner receiver member 37 is inclined so that the toner receiving surface 37*b* facing the developing roller 31 has a rising slope from the toner supply roller 30 side to the photosensitive drum 1*a* side, while the toner dropping surface 37*c* facing the toner supply roller 30 is substantially vertical. In addition, the angle of the toner receiving surface 37*b* and surface roughness (coefficient of friction) of the same are adjusted so that the toner deposited on the toner receiving surface 37*b* does not naturally drop due to the gravity or vibration when the developing device 3*a* is driven.

As illustrated in FIGS. 6 and 7, the toner receiver member 37 is contacted with the support member main body 36 only at an edge 37*f* on the toner supply roller 30 side, and an edge 37*g* on the other side (on the photosensitive drum 1*a* side) is a free end. Further, a substantially middle portion of the toner receiving surface 37*b* in the width direction (the left and right direction in FIG. 6) is supported by the support member main body 36 via the vibration generating device 42. In this way, the toner receiver member 37 is capable of swinging about the edge 37*f* as a pivot. In addition, the vibration motor 43 is disposed so that its output shaft 43*a* is substantially parallel to the longitudinal direction of the toner receiver member 37.

The developing devices 3*a* to 3*d* of this embodiment can execute a toner collecting mode in a non-image formation period, in which the vibration generating device 42 vibrates the toner receiver members 37 in the developing devices 3*a* to 3*d* so that toner deposited on the toner receiving surface 37*b* is shaken off by vibration. Specifically, in the non-image formation period, the output shaft 43*a* of the vibration motor 43 is rotated fast (e.g. at approximately 10,000 rpm), and the vibration weight 50 is also rotated fast together with the output shaft 43*a*. In this case, uneven centrifugal force is applied to the vibration weight 50, so the vibration generating device 42 including the vibration motor 43 and the motor mounting plate 42*a* is vibrated via the output shaft 43*a*. Further, the toner receiver member 37 equipped with the vibration generating device 42 is also vibrated. Specifically, the toner receiving surface 37*b* of the toner receiver member 37 is vibrated about the edge 37*f* as a pivot so that amplitude of the vibration becomes larger as being closer to the edge 37*g*. This vibration of the toner receiver member 37 lifts up the toner deposited on the toner receiving surface 37*b* on the edge 37*g* side to the edge 37*f* side (in the white arrow direction) so that the toner moves to the edge 37*f* side little by little.

As illustrated in FIG. 7, the vibration of the of the toner receiving surface 37*b* causes toner T deposited on the toner receiving surface 37*b* to slide down along the slope of the toner receiving surface 37*b* (in the white arrow direction in FIG. 7), and the toner drops freely to a region R between the toner dropping surface 37*c* that is substantially vertical and the toner supply roller 30. A part of the toner dropped to the region R passes through a gap between the ear-breaking blade 33 and the toner supply roller 30 as it is, and drops into the feed conveying chamber 20*c*.

In this embodiment, in order to put the dropped toner in the region R back to the feed conveying chamber 20*c*, the developing roller 31 and the toner supply roller 30 are rotated in the non-image formation period in a direction opposite to that in the image formation period (in the clockwise direction in FIG. 6) (i.e. reversely rotated). When the toner supply roller 30 is reversely rotated, the toner dropped to the region R and deposited on the tip of the ear-breaking blade 33 is scraped by the magnetic brush of the toner supply roller 30, rotates along with the surface of the toner supply roller 30, passes through the gap between the toner supply roller 30 and the ear-breaking blade 33, is removed from the toner supply roller 30 at the same pole part of the fixed magnet body, and then is forcibly put back to the feed conveying chamber 20*c*.

The timing when the toner receiver member 37 is vibrated may be every time when the printing operation is finished. Otherwise, it may be timing when the number of printed sheets reaches a predetermined number or when temperature in the developing device 3*a* becomes a predetermined temperature or higher, or other predetermined timing. In addition, the timing when the toner receiver member 37 is vibrated may be the same as or different from the timing when the developing roller 31 and the toner supply roller 30 are reversely rotated. In addition, by vibrating the toner receiver member 37 every time when the number of printed sheets reaches a predetermined number, the vibration of the toner receiver member 37 is automatically performed in accordance with the number of printed sheets. Accordingly, the user is not required to manually set vibration of the toner receiver member 37, and hence it is possible to avoid setting error, forgetting to set, or execution of unnecessary vibration.

Figure 8:
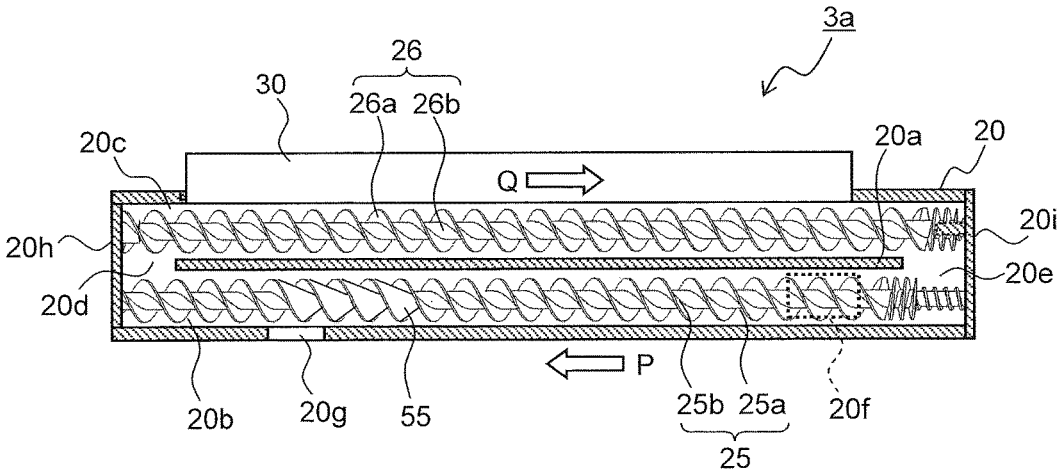
FIG. 8 is a cross-sectional plan view illustrating a structure of a stirring portion of the developing device of the first embodiment.

FIG. 8 is a cross-sectional plan view illustrating stirring portions of the developing device 3*a* of the first embodiment (XX' cross-sectional view in FIG. 2). As described above, the developing container 20 includes the stirring and conveying chamber 20*b*, the feed conveying chamber 20*c*, the partition wall 20*a*, the upstream side communicating portion 20*d*, and the downstream side communicating portion 20*e*. In addition, the developing container 20 includes the developer replenishing port 20*f*, a developer discharging portion 20*g*, an upstream side wall portion 20*h*, and a downstream side wall portion 20*i*. Note that in the stirring and conveying chamber 20*b*, the right side in FIG. 8 is the upstream side, while the left side in FIG. 8 is the downstream side. Further, in the feed conveying chamber 20*c*, the left side in FIG. 8 is the upstream side, while the right side in FIG. 8 is the downstream side. Therefore, the upstream and the downstream of the communicating portion and the side wall portion are referred to with respect to the feed conveying chamber 20*c*.

The partition wall 20*a* extends in the longitudinal direction of the developing container 20 so as to divide between the stirring and conveying chamber 20*b* and the feed conveying chamber 20*c*, which are parallel. The left side end portion of the partition wall 20*a* in the longitudinal direction forms the upstream side communicating portion 20*d* together with the inner wall portion of the upstream side wall portion 20*h*. In contrast, the right side end portion of the partition wall 20*a* in the longitudinal direction forms the downstream side communicating portion 20*e* together with the inner wall portion of the downstream side wall portion 20*i*. The developer passes through the stirring and conveying chamber 20*b*, the upstream side communicating portion 20*d*, the feed conveying chamber 20*c*, and the downstream side communicating portion 20*e* in order to circulate in the developing container 20.

The developer replenishing port 20*f* is an opening to replenish the developing container 20 with new toner and carrier from the toner container 4*a* disposed above the developing container 20 (see FIG. 1), and it is formed at the upstream side (the right side in FIG. 8) of the stirring and conveying chamber 20*b*.

The developer discharging portion 20*g* is a portion to discharge excess developer in the stirring and conveying chamber 20*b* and the feed conveying chamber 20*c* due to the replenishment of the toner and carrier. The developer discharging portion 20*g* is disposed to open at a predetermined height on a side surface of the stirring and conveying chamber 20*b*.

The stirring and conveying screw 25 (first stirring and conveying member) disposed in the stirring and conveying chamber 20*b* includes a rotation shaft 25*b* and a first helical blade 25*a* that is integral to the rotation shaft 25*b* and is formed in a helical shape having a constant pitch in the axial direction of the rotation shaft 25*b*. In addition, the first helical blade 25*a* extends to both end portion sides in the longitudinal direction of the stirring and conveying chamber 20*b* so as to face the upstream side and downstream side communicating portions 20*d* and 20*e*, too. The rotation shaft 25*b* is pivoted by the upstream side wall portion 20*h* and the downstream side wall portion 20*i* of the developing container 20 in a rotatable manner.

The feed conveying screw 26 (second stirring and conveying member) disposed in the feed conveying chamber 20*c* includes a rotation shaft 26*b* and a second helical blade 26*a* that is integral to the rotation shaft 26*b* and is formed in a helical shape having the same pitch as the first helical blade 25*a* in the axial direction of the rotation shaft 26*b* in a direction opposite to the first helical blade 25*a* (in the opposite phase). In addition, the second helical blade 26*a* has a length larger than or equal to the axial direction length of the toner supply roller 30. Further, the second helical blade 26*a* extends to a position facing the upstream side communicating portion 20*d*. The rotation shaft 26*b* is disposed in parallel to the rotation shaft 25*b* and is pivoted by the upstream side wall portion 20*h* and the downstream side wall portion 20*i* of the developing container 20 in a rotatable manner.

In the developing process in which new developer is not replenished, the developer is circulated and stirred in the stirring and conveying chamber 20*b*, the upstream side communicating portion 20*d*, the feed conveying chamber 20*c*, and the downstream side communicating portion 20*e*, and the stirred developer is supplied to the toner supply roller 30.

As the toner is consumed in the developing process, the developer containing toner and carrier is replenished into stirring and conveying chamber 20*b* from the developer replenishing port 20*f*. The replenished developer is conveyed in the arrow P direction in the stirring and conveying chamber 20*b* in the same manner as in the developing process, and it is conveyed into the feed conveying chamber 20*c* through the upstream side communicating portion 20*d*. Further, it is conveyed in the arrow Q direction in the feed conveying chamber 20*c*, and is conveyed into the stirring and conveying chamber 20*b* through the upstream side communicating portion 20*d*. The carrier in the developer is not consumed in the developing process, and a volume of the developer in the developing container 20 is increased. As a result, excess developer (of substantially the same amount as that of the developer replenished from the developer replenishing port 20*f*) is discharged to outside of the developing container 20 through the developer discharging portion 20*g*.

In addition, in order to execute the forced discharge mode described later, the stirring and conveying screw 25 disposed in the stirring and conveying chamber 20*b* is provided with a convey amount adjusting portion 55 that keeps the developer retained near the developer discharging portion 20*g* when the forced discharge mode is executed.

Figure 9:
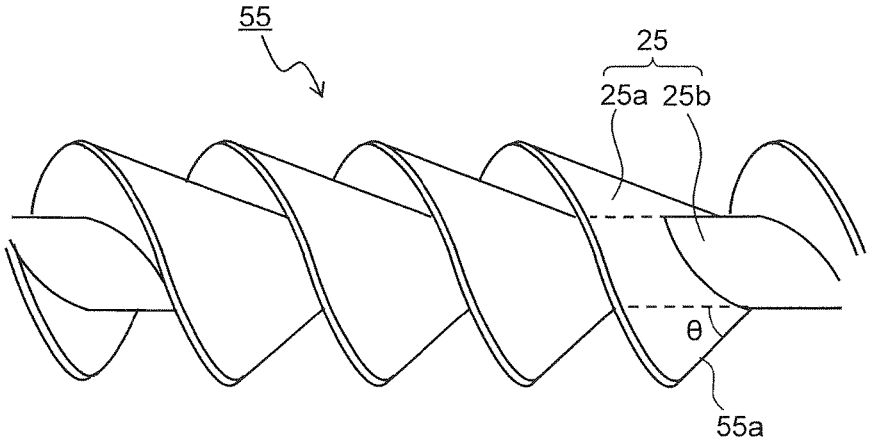
FIG. 9 is a partially enlarged view of a convey amount adjusting portion provided to a stirring and conveying screw of the developing device of the first embodiment.

FIG. 9 is a partially enlarged view of the convey amount adjusting portion 55 provided to the stirring and conveying screw 25 of the developing device 3*a* of this embodiment. The first helical blade 25*a* constituting the convey amount adjusting portion 55 has a smaller inclination angle θ of a conveying surface 55*a* (the right side surface in FIG. 9) with respect to the rotation shaft 25*b* in reverse rotation than that of the first helical blades 25*a* formed on the upstream side and the downstream side of the convey amount adjusting portion 55 in the developer conveying direction. In other words, the convey amount adjusting portion 55 has a shape such that a conveying amount of the developer in reverse rotation becomes smaller than that in forward rotation (in the image formation period).

As illustrated in FIG. 8, in the image formation period, the forward rotation of the stirring and conveying screw 25 generates a conveying force in the arrow P direction in the stirring and conveying chamber 20*b*, while the forward rotation of the feed conveying screw 26 generates a conveying force in the arrow Q direction in the feed conveying chamber 20*c*. In this case, the conveying amount of the developer is not decreased in the convey amount adjusting portion 55, and hence a retention of developer does not occur.

The toner that deposits on the toner receiver member 37 is scattering toner floating in the developing container 20 and is unstable for electrification. Therefore, if the developer containing the toner shaken off by vibration from the toner receiver member 37 forms the magnetic brush on the toner supply roller 30 and if the toner moves from the toner supply roller 30 to the developing roller 31 and is used for developing, a malfunction such as a fogged image may occur.

In the present disclosure, therefore, when the toner collecting mode is executed so that the toner deposited on the toner receiver member 37 is collected into the developing container 20 by vibration, a forced discharge mode is executed in which the developer containing much collected toner is forcibly discharged to outside of the developing device 3*a*. An execution procedure of the toner collecting mode and the forced discharge mode in the developing device 3*a* of the first embodiment is described below in detail. Note that the developing devices 3*b* to 3*d* also execute the toner collecting mode and the forced discharge mode in the entirely same procedure.

First, as described above, the toner collecting mode is executed at a predetermined timing, in which the toner receiver member 37 is vibrated so that the toner deposited on the toner receiving surface 37*b* is shaken off by vibration. The toner slid and dropped from the toner receiver member 37 is put back into the feed conveying chamber 20*c*.

Figure 10:
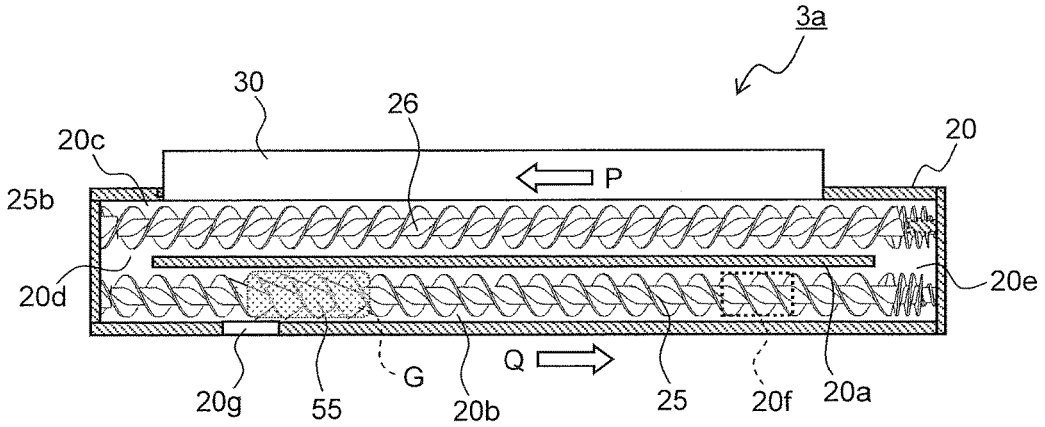
FIG. 10 is a cross-sectional plan view of the stirring portion when a forced discharge mode is executed in the developing device of the first embodiment.

Next, the forced discharge mode is executed after the toner collecting mode. FIG. 10 is a cross-sectional plan view illustrating the stirring portions when the forced discharge mode is executed in the developing device 3*a* of the first embodiment. As illustrated in FIG. 10, when the forced discharge mode is executed in which the stirring and conveying screw 25 and the feed conveying screw 26 are reversely rotated, the reverse rotation of the stirring and conveying screw 25 generates a conveying force in the arrow Q direction in the stirring and conveying chamber 20*b*. Further, the conveying amount of the developer is decreased at the convey amount adjusting portion 55. As a result, a retention G of the developer occurs near the downstream side of the developer discharging portion 20*g* in the developer conveying direction (arrow Q direction) in reverse rotation.

Figure 11:
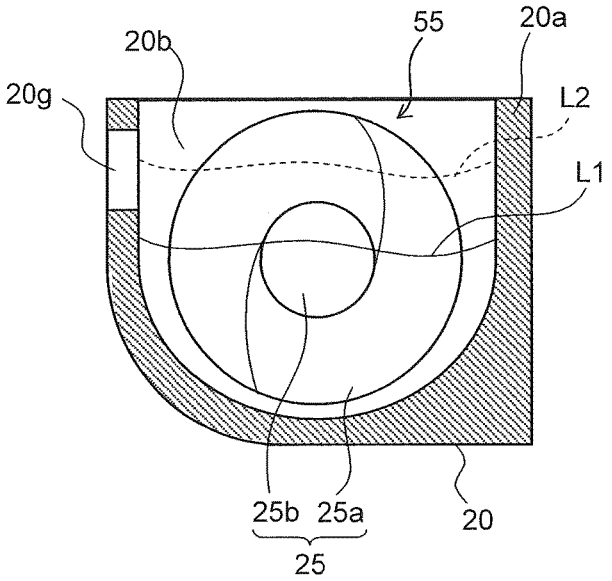
FIG. 11 is a cross-sectional side view of a convey amount adjusting portion and its vicinity of a stirring and conveying chamber in the developing device of the first embodiment, viewed from the upstream side in a developer conveying direction.

FIG. 11 is a cross-sectional side view of the convey amount adjusting portion 55 and its vicinity of the developing device 3*a* of the first embodiment viewed from the upstream side in the developer conveying direction (the right side in FIG. 10). As illustrated in FIG. 11, the developer discharging portion 20*g* is disposed at an upper part of the side surface of the stirring and conveying chamber 20*b*. In the image formation period in which the stirring and conveying screw 25 rotates forward, a retention of the developer does not occur at the convey amount adjusting portion 55, and the level (volume) of the developer in the stirring and conveying chamber 20*b* is lower than the developer discharging portion 20*g* (a solid line L1 in FIG. 11). Therefore, the developer is not discharged from the developer discharging portion 20*g*.

In contrast, when the forced discharge mode is executed in which the stirring and conveying screw 25 rotates reverse, the retention G of the developer occurs in the convey amount adjusting portion 55, and the level (volume) of the developer in the stirring and conveying chamber 20*b* at the developer discharging portion 20*g* and its vicinity is higher than the lower end portion of the developer discharging portion 20*g* (a broken line L2 in FIG. 11). In this way, a part of the developer containing the collected toner is discharged from the developer discharging portion 20*g*. Therefore, before the volume of developer is increased by replenishment of new developer, developer containing the collected toner can be discharged from the developer discharging portion 20*g*.

As this forced discharge mode is executed after the toner collecting mode, developer can be discharged corresponding to the timing when the collected toner is put back to the feed conveying chamber 20*c*, and the collected toner having unstable charged amount can be efficiently discharged.

Therefore, a fogged image and scattering of toner due to electrification error of toner in the developer can be effectively suppressed.

Execution timing of the forced discharge mode is not particularly limited as long as it is in the non-image formation period, but it is preferred that the timing be just after the toner collecting mode is executed in which the vibration generating device 42 is operated so that toner deposited on the toner receiver member 37 is collected into the developing container 20. In addition, it may be possible to change the execution timing of the forced discharge mode in accordance with use conditions or environmental conditions of the developing device 3*a*.

In addition, the collected toner is collected in the entire region of the toner supply roller 30 in the longitudinal direction, and therefore it is preferred that the execution time of the forced discharge mode be longer than or equal to conveying time of the developer from the upstream side end portion of the toner supply roller 30 to the developer discharging portion 20*g*. The conveying time can be calculated using a developer circulation speed in the forced discharge mode and a distance between the upstream side end portion (right end portion in FIG. 8) of the toner supply roller 30 and the developer discharging portion 20*g*.

Figure 12:
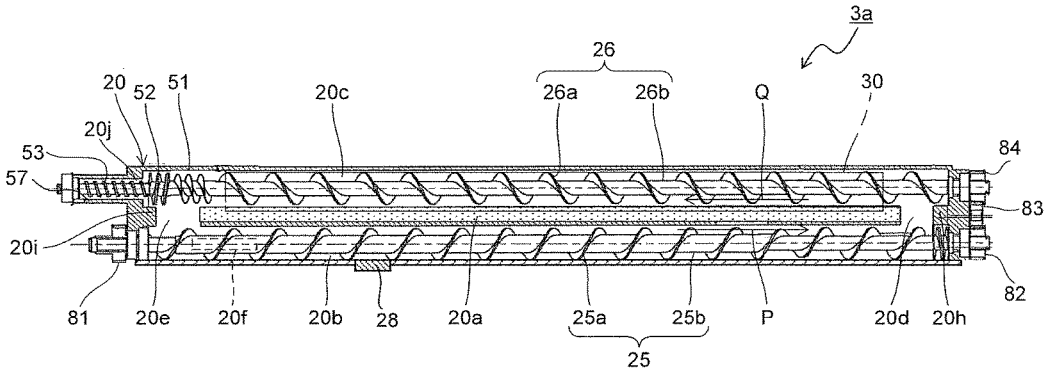
FIG. 12 is a cross-sectional plan view illustrating a structure of the stirring portion of the developing device according to a second embodiment of the present disclosure.

FIG. 12 is a cross-sectional plan view of the stirring portion of the developing device 3*a* according to a second embodiment of the present disclosure (XX' cross-sectional view in FIG. 2). In this embodiment, a first developer discharging portion 20*j* is provided for discharging excess developer in the stirring and conveying chamber 20*b* and the feed conveying chamber 20*c* that becomes excessive due to replenishment of toner and carrier. The first developer discharging portion 20*j* is a pipe-like conveying path provided cylindrically and continuously to the feed conveying chamber 20*c* in the longitudinal direction at the downstream side of the feed conveying chamber 20*c*.

In addition, the rotation shaft 26*b* of the feed conveying screw 26 disposed in the feed conveying chamber 20*c* is provided with the second helical blade 26*a* as well as a speed reducing conveying portion 51, a restricting portion 52, and a discharging blade 53 in an integral manner. The structure of other portions of the developing device 3*a* is the same as that in the first embodiment.

The speed reducing conveying portion 51 is constituted of a plurality of (three in this example) blades in a helical shape facing the same direction as the second helical blade 26*a*. The helical blade constituting the speed reducing conveying portion 51 has the same outer diameter as the second helical blade 26*a* and a smaller pitch than the second helical blade 26*a*.

The restricting portion 52 blocks the developer conveyed to the downstream side in the feed conveying chamber 20*c* and conveys the developer above a predetermined amount to the first developer discharging portion 20*j*. The restricting portion 52 is constituted of a helical blade provided to the rotation shaft 26*b* formed in a helical shape facing a direction opposite to (in an opposite phase to) the second helical blade 26*a*, and it has substantially the same outer diameter as the second helical blade 26*a* and a smaller pitch than the second helical blade 26*a*. In addition, the restricting portion 52 forms a gap having a predetermined size between the inner wall portion of the developing container 20 at the downstream side wall portion 20*i* and the like and the periphery of the restricting portion 52. The excess developer is discharged through this gap. In other words, the speed reducing conveying portion 51 and the restricting portion 52 have the same function as the convey amount adjusting portion 55 in the first embodiment.

The rotation shaft 26*b* in the first developer discharging portion 20*j* is provided with the discharging blade 53. The discharging blade 53 is made of a blade having a helical shape facing the same direction as the second helical blade 26*a*, a smaller pitch and a smaller outer diameter than the second helical blade 26*a*. Therefore, when the rotation shaft 26*b* is rotated, the discharging blade 53 is also rotate, and the excess developer conveyed over the restricting portion 52 into the first developer discharging portion 20*j* is sent to the left side in FIG. 3 and is discharged to outside of the developing container 20. Note that the discharging blade 53, the restricting portion 52, and the second helical blade 26*a* are molded of synthetic resin integrally with the rotation shaft 26*b*. In addition, an outlet 57 communicating to a waste toner convey pipe (not shown) is formed below the first developer discharging portion 20*j*.

The outer wall of the developing container 20 is provided with gears 81 to 84. The gears 81 and 82 are fixed to the rotation shaft 25*b*, while the gear 84 is fixed to the rotation shaft 26*b*. The gear 83 is retained by the developing container 20 in a rotatable manner and engages with the gears 82 and 84. A clutch is embedded in the gear 83 so that the stirring and conveying screw 25 and the feed conveying screw 26 can be driven separately.

In the developing process in which developer is not newly replenished, developer is circulated and stirred in the stirring and conveying chamber 20*b*, the upstream side communicating portion 20*d*, the feed conveying chamber 20*c*, and the downstream side communicating portion 20*e*, and the stirred developer is supplied to the toner supply roller 30.

As the toner is consumed in the developing process, developer containing toner and carrier is replenished into the stirring and conveying chamber 20*b* from the developer replenishing port 20*f*. The replenished developer is conveyed by the first helical blade 25*a* in the arrow P direction in the stirring and conveying chamber 20*b* in the same manner as in the developing process. After that, the developer is conveyed into the feed conveying chamber 20*c* through the upstream side communicating portion 20*d*. Further, the second helical blade 26*a* conveys the developer in the feed conveying chamber 20*c* in the arrow Q direction, and the developer is conveyed to the speed reducing conveying portion 51. When the restricting portion 52 rotates along with rotation of the rotation shaft 26*b*, the restricting portion 52 gives the developer a conveying force in a direction opposite to the developer conveying direction by the second helical blade 26*a*. The developer whose moving speed is reduced in the speed reducing conveying portion 51 is blocked at the speed reducing conveying portion 51 and its vicinity positioned on the upstream side of the restricting portion 52 to increase its volume, and excess developer (of substantially the same volume as the developer replenished from the developer replenishing port 200 passes over the restricting portion 52 and is discharged to outside of the developing container 20 through the first developer discharging portion 20*j*. The structure of other portions of the developing device 3*a*, the structures of the toner receiver member 37 and the vibration generating device 42, and the execution procedure and execution timing in the toner collecting mode are the same as those in the first embodiment.

Also in the developing device 3*a* of the second embodiment, similarly to the first embodiment, when the toner deposited on the toner receiver member 37 is collected into the developing container 20 by vibration as the toner collecting mode is executed, the forced discharge mode is executed in which developer containing much collected toner is forcibly discharged to outside of the developing device 3*a*. An execution procedure of the toner collecting mode and the forced discharge mode in the developing device 3*a* of the second embodiment is described below in detail. Note that the developing devices 3*b* to 3*d* also execute the toner collecting mode and the forced discharge mode in the entirely same procedure.

First, as described above, the toner collecting mode is executed at a predetermined timing, in which the toner receiver member 37 is vibrated so that toner deposited on the toner receiving surface 37*b* is shaken off by vibration. The toner slid and dropped from the toner receiver member 37 is put back to the feed conveying chamber 20*c*.

Figure 13:
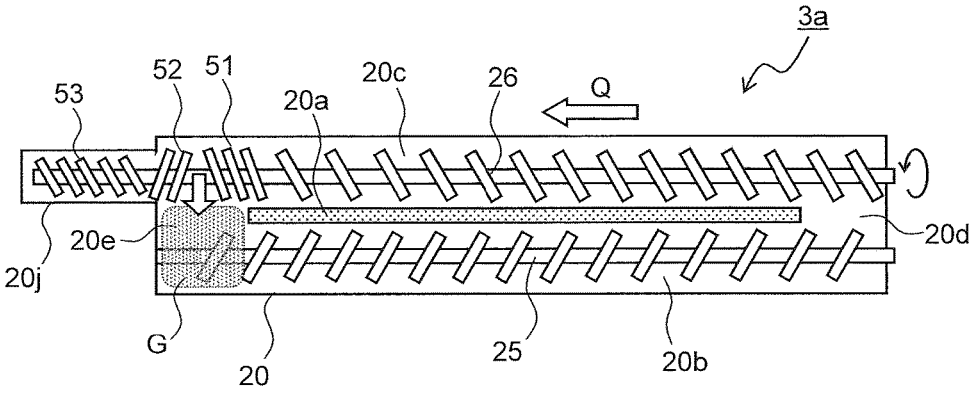
FIG. 13 is a cross-sectional plan view illustrating the stirring portion when a forced discharge mode is executed in the developing device of the second embodiment.

Next, the forced discharge mode is executed after the toner collecting mode. FIG. 13 is a cross-sectional plan view illustrating the stirring portion when the developing device 3*a* of the second embodiment executes the forced discharge mode. The developing device 3*a* of this embodiment stops driving the stirring and conveying screw 25 and drives only the feed conveying screw 26 so that the forced discharge mode is executed. In the feed conveying chamber 20*c* the feed conveying screw 26 is driven to generate the conveying force in the arrow Q direction, but in the stirring and conveying chamber 20*b* the stirring and conveying screw 25 is stopped so that a conveying force is not generated.

In this way, circulation of developer from the feed conveying chamber 20*c* to the stirring and conveying chamber 20*b* is prevented, and the retention G of the developer occurs at the downstream side communicating portion 20*e* and its vicinity. As a result, a volume of developer is increased locally at the restricting portion 52 and its vicinity, and a part of the developer passes over the restricting portion 52 and is discharged to outside of the developing container 20 from the first developer discharging portion 20*j*. Therefore, developer can be discharged from the first developer discharging portion 20*j* before the volume of developer increases due to replenishment of new developer.

By executing this forced discharge mode after the toner collecting mode, it is possible to discharge developer in accordance with the timing when the collected toner is put back to the feed conveying chamber 20*c*, so that the collected toner having unstable charged amount can be efficiently discharged. Therefore, a fogged image and scattering of toner due to electrification error of toner in the developer can be effectively suppressed.

In addition, the drive of the stirring and conveying screw 25 is stopped in the second embodiment, but the same effect can be obtained by reducing the rotation speed of the stirring and conveying screw 25 to be lower than normal so that retention of developer occurs.

Execution timing of the forced discharge mode is not particularly limited as long as it is in the non-image formation period, but it is preferred that the timing be timing when the toner collecting mode is executed in which the vibration generating device 42 is operated so that toner deposited on the toner receiver member 37 is collected into the developing container 20. In addition, it may be possible to change the execution timing of the forced discharge mode in accordance with use conditions or environmental conditions of the developing device 3*a*.

In addition, the collected toner is collected in the entire region of the toner supply roller 30 in the longitudinal direction, and therefore it is preferred that the execution time of the forced discharge mode be longer than or equal to conveying time of the developer from the upstream side end portion of the toner supply roller 30 to the first developer discharging portion 20*j*. The conveying time can be calculated using a developer circulation speed in the forced discharge mode and a distance between the upstream side end portion (right end portion in FIG. 13) of the toner supply roller 30 and the first developer discharging portion 20*j*.

Figure 14:
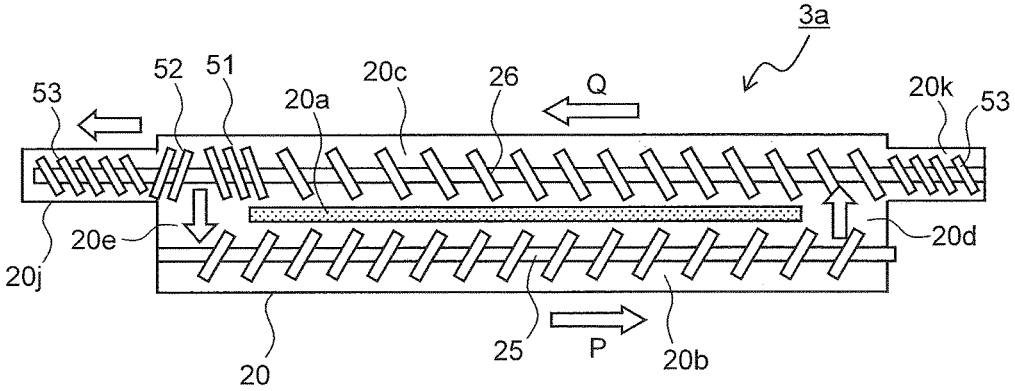
FIG. 14 is a cross-sectional plan view illustrating a structure of the stirring portion of the developing device according to a third embodiment of the present disclosure.

FIG. 14 is a cross-sectional plan view of a structure of the stirring portion of the developing device 3*a* according to a third embodiment of the present disclosure. In this embodiment, in addition to the first developer discharging portion 20*j* that discharges excess developer in replenishment of the developer, a second developer discharging portion 20*k* is disposed, which discharges the developer when the forced discharge mode is executed. The structure of other portions of the stirring portion of the developing device 3*a* and the structure of the toner receiver member 37 and its vicinity are the same as those in the second embodiment illustrated in FIGS. 12 and 13.

As illustrated in FIG. 14, in the image formation period, the rotation of the stirring and conveying screw 25 generates a conveying force in the arrow P direction in the stirring and conveying chamber 20*b*, while the rotation of the feed conveying screw 26 generates a conveying force in the arrow Q direction in the feed conveying chamber 20*c*. When new developer is replenished from the developer replenishing port 20*f* along with consumption of toner in the developing container 20, because the carrier in the developing container 20 is not consumed in the image forming process, the volume of the developer in the developing device 3*a* is increased by amount of the replenished developer (carrier). When the developer is conveyed from the feed conveying screw 26 to the stirring and conveying screw 25, excess developer passes over the restricting portion 52 and is discharged through the first developer discharging portion 20*j*.

In other words, the developer circulates in the developing container 20 in the counterclockwise direction in FIG. 14, and the developer in the feed conveying chamber 20*c* is conveyed in the direction opposite to the second developer discharging portion 20*k* and is not directed to the second developer discharging portion 20*k*. In addition, the discharging blade 53 in the second developer discharging portion 20*k* faces the same direction (the same phase) as the second helical blade 26*a* of the feed conveying screw 26, and hence the discharging blade 53 generates a conveying force in the direction from the second developer discharging portion 20*k* to the feed conveying chamber 20*c*. Therefore, the developer is not discharged from the second developer discharging portion 20*k*.

Figure 15:
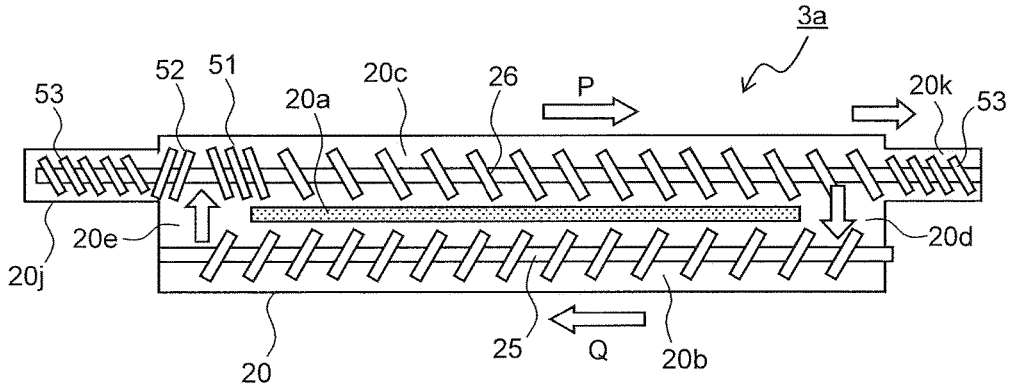
FIG. 15 is a cross-sectional plan view of the stirring portion when the forced discharge mode is executed in the developing device of the third embodiment.

In this embodiment, the stirring and conveying screw 25 and the feed conveying screw 26 are reversely rotated so that the forced discharge mode is executed. FIG. 15 is a cross-sectional plan view of the stirring portion of the developing device 3*a* of the third embodiment when the forced discharge mode is executed. When the stirring and conveying screw 25 and the feed conveying screw 26 are reversely rotated, the circulation direction of the developer in the developing container 20 is switched to the clockwise direction. As a result, the developer in the feed conveying chamber 20*c* is conveyed in the direction to the second developer discharging portion 20*k*. In addition, the discharging blade 53 in the second developer discharging portion 20*k* generates a conveying force in the direction from the feed conveying chamber 20*c* to the second developer discharging portion 20*k*. In this way, when the developer is passed from the feed conveying screw 26 to the stirring and conveying screw 25, a part of the developer is discharged through the second developer discharging portion 20*k*.

By executing this forced discharge mode after the toner collecting mode, similarly to the first and second embodiments, it is possible to discharge the developer in accordance with the timing when the collected toner is put back to the feed conveying chamber 20*c*. Thus, the collected toner having unstable charged amount can be efficiently discharged. Therefore, a fogged image and scattering of toner due to electrification error of toner in the developer can be effectively suppressed. The execution timing of the forced discharge mode can be also set similarly to the first and second embodiments.

In addition, the collected toner is collected in the entire region of the toner supply roller 30 in the longitudinal direction, and hence the execution time of the forced discharge mode is preferably set to be longer than or equal to the conveying time of the developer from the downstream side end portion (left end portion in FIG. 15) of the toner supply roller 30 to the second developer discharging portion 20*k*. The conveying time can be calculated using a developer circulation speed in the forced discharge mode and a distance between the downstream side end portion of the toner supply roller 30 and the second developer discharging portion 20*k*.

Figure 16:
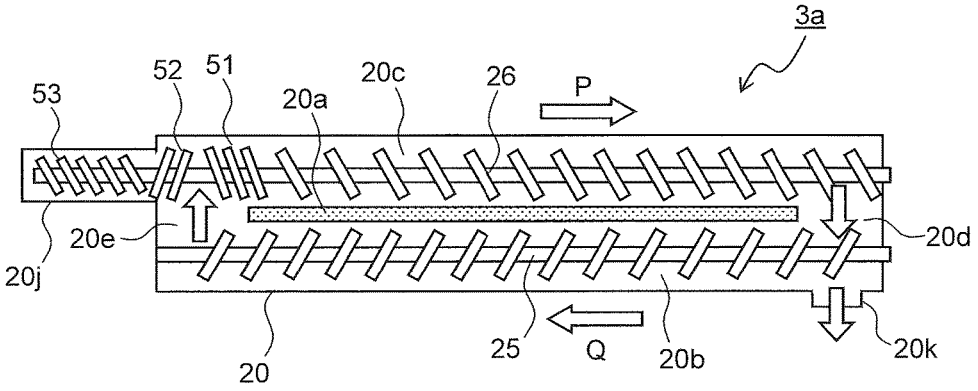
FIG. 16 is a cross-sectional plan view of the stirring portion when the forced discharge mode is executed in a developing device according to a variation of the third embodiment.

FIG. 16 is a cross-sectional plan view of the stirring portion of the developing device 3*a* of a variation of the third embodiment when the forced discharge mode is executed. In this variation, the second developer discharging portion 20*k* is disposed on the side surface of the stirring and conveying chamber 20*b* at a position facing the upstream side communicating portion 20*d* as a delivery portion from the feed conveying screw 26 to the stirring and conveying screw 25. The structure of other portions of the developing device 3*a* is the same as that in the third embodiment illustrated in FIG. 14.

Also in this variation, in the image formation period, the rotation of the stirring and conveying screw 25 generates a conveying force in the arrow P direction in the stirring and conveying chamber 20*b*, while the rotation of the feed conveying screw 26 generates a conveying force in the arrow Q direction in the feed conveying chamber 20*c*. In other words, the developer is passed from the stirring and conveying chamber 20*b* to the feed conveying chamber 20*c* at the upstream side communicating portion 20*d*, and hence the developer is not discharged from the second developer discharging portion 20*k*.

In contrast, when the forced discharge mode is executed in which the stirring and conveying screw 25 and the feed conveying screw 26 are reversely rotated, the circulation direction of the developer in the developing container 20 is switched to the clockwise direction as illustrated in FIG. 16. As a result, the developer is passed from the feed conveying chamber 20*c* to the stirring and conveying chamber 20*b* at the upstream side communicating portion 20*d*, and hence the developer in the feed conveying chamber 20*c* is conveyed in the direction to the second developer discharging portion 20*k*, so that a part of the developer is discharged through the second developer discharging portion 20*k*. By executing this forced discharge mode after the toner collecting mode, it is possible to discharge the developer in accordance with the timing when the collected toner is put back to the feed conveying chamber 20*c*.

Note that the second developer discharging portion 20*k* is disposed on the side surface of the stirring and conveying chamber 20*b* at a position facing the upstream side communicating portion 20*d* in the variation illustrated in FIG. 16, but the position at which the second developer discharging portion 20*k* is disposed is not limited to this. For instance, the second developer discharging portion 20*k* may be disposed on the side surface of the feed conveying chamber 20*c* at a position facing the downstream side communicating portion 20*e*. In other words, the second developer discharging portion 20*k* may be disposed on the side surface of the developing container 20 so as to be perpendicular to the developer conveying direction in the developing container 20 on the upstream side when the stirring and conveying screw 25 and the feed conveying screw are forward rotation, so that the developer can be discharged through the second developer discharging portion 20*k* when the stirring and conveying screw 25 and the feed conveying screw 26 are reversely rotated.

When the color printer 100 is set to a mode for appropriately setting image density and registration (hereinafter referred to as a calibration mode), yellow, cyan, magenta, and black image forming portions Pa to Pd transfer toners onto the intermediate transfer belt 8 so as to form patch images (datum images) of individual colors, and their toner amounts and deviation amounts from a reference position are detected, so that density and color deviations are corrected. As a method of adjusting image density, there is a method in which electrification potentials of the photosensitive drums 1*a* to 1*d*, toner concentrations in the developers in the developing devices 3*a* to 3*d*, developing bias potentials, or exposing light intensity of the exposing device 5 are adjusted in accordance with the detected image density.

Figure 17:
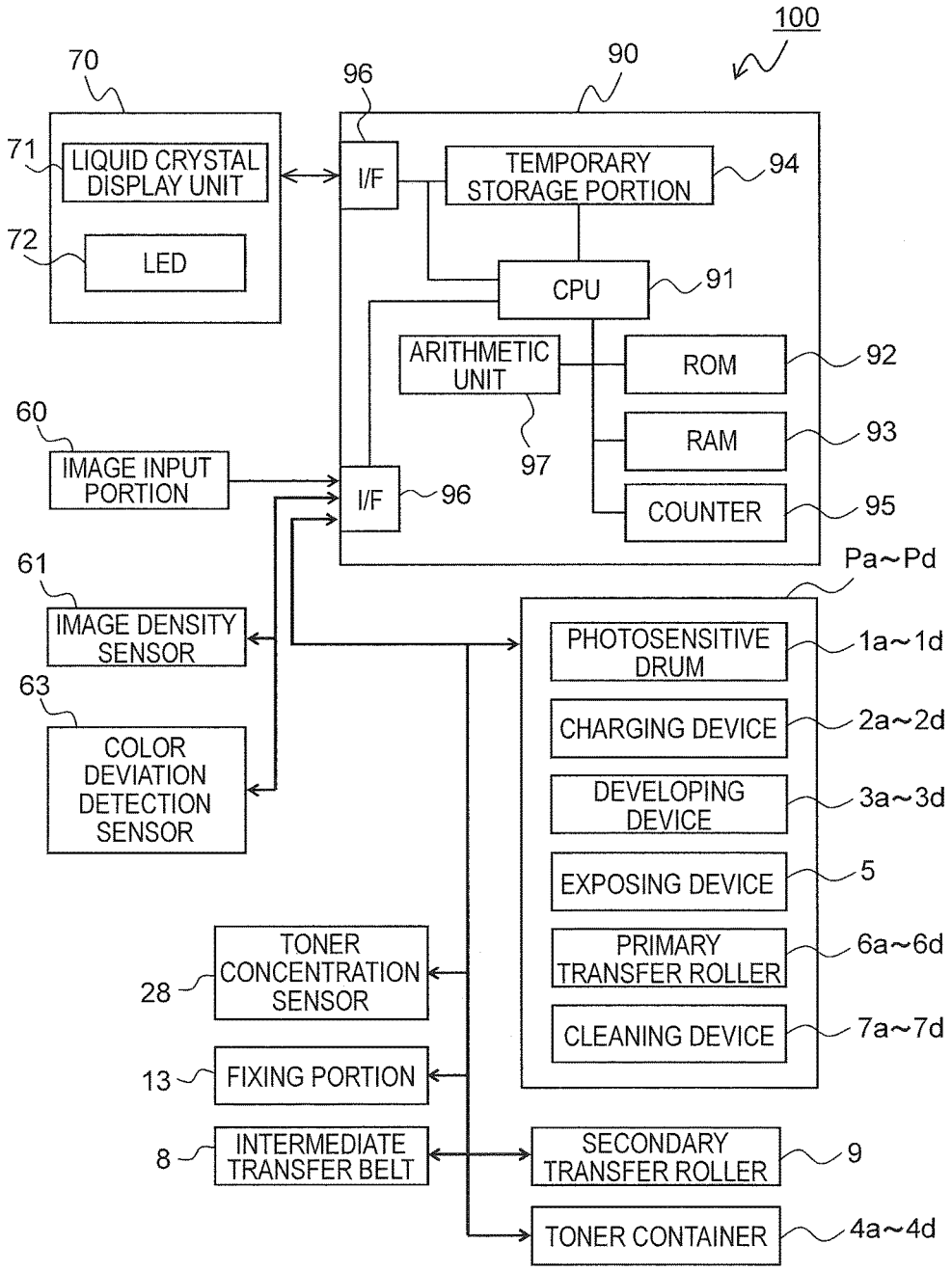
FIG. 17 is a block diagram illustrating an example of control paths of the color printer.

FIG. 17 is a block diagram illustrating a control path of the color printer 100. Note that various controls of individual portions of the apparatus are performed when the color printer 100 is used, and hence the control path of the entire color printer 100 is complicated. Accordingly, in the following description, portions of the control path, which are necessary for performing the present disclosure are mainly described.

An image input portion 60 is a receiving portion that receives image data transmitted from a personal computer or the like to the color printer 100. The image signal received by the image input portion 60 is converted into a digital signal, which is sent out to a temporary storage portion 94.

An image density sensor 61 detects a toner adhesion amount of a patch image for density correction of each color formed on the intermediate transfer belt 8. As the image density sensor 61, an optical sensor is generally used, which is constituted of a light emitting element such as an LED and a light receiving element such as a photodiode. In order to measure the toner adhesion amount on the intermediate transfer belt 8, when the light emitting element irradiates each patch image with measuring light, the measuring light is reflected by the toner or the surface of the intermediate transfer belt 8 and enters the light receiving element.

If the toner adhesion amount is large, the light reflected by the surface of the intermediate transfer belt 8 is blocked by the toner, and hence intensity of light received by the light receiving element is decreased. In contrast, if the toner adhesion amount is small, on the contrary, the light reflected from the surface of the intermediate transfer belt 8 is increased, and consequently the intensity of light received by the light receiving element is increased. Therefore, on the basis of an output value of the light receiving signal based on the intensity of the received reflection light, a datum image density of each color is detected and compared with a predetermined reference density so that a characteristic value of the developing bias or the like is adjusted. Thus, density correction is performed for each color.

A color deviation detection sensor 63 detects a position of a patch image for color deviation correction of each color formed on the intermediate transfer belt 8. As the color deviation detection sensor 63, a reflection type optical sensor similar to the image density sensor 61 is used, but it may be possible to use other sensors.

An operation portion 70 includes an liquid crystal display unit 71, and an LED 72 indicating various states, so as to indicate a state of the color printer 100 and display an image formation situation and the number of print copies. Various settings of the color printer 100 are made using a printer driver of the personal computer.

The control unit 90 includes at least a central processing unit (CPU) 91, a read only memory (ROM) 92 that is dedicated to reading, a random access memory (RAM) 93 that can be written and read, a temporary storage portion 94 in which image data or the like is temporarily stored, a counter 95, a plurality of (two in this example) interfaces (I/Fs) 96 that transmits control signals to individual devices in the color printer 100 and receives an input signal from the operation portion 70, and an arithmetic unit 97.

The ROM 92 stores a control program for the color printer 100 and data such as numeric values necessary for control, which are not changed during use of the color printer 100. The RAM 93 stores necessary data generated during control of the color printer 100, data temporarily necessary for controlling the color printer 100, and other data. In addition, the RAM 93 (or the ROM 92) stores toner adhesion amount data necessary in the calibration mode, which is a relationship between the output value of the image density sensor 61 and the toner adhesion amount, and stores a density correction table in which a toner concentration determined from the toner adhesion amount and parameter values used for density correction such as the charged amount, the characteristic value of the developing bias or the exposing light intensity are associated with each other, and a color deviation correction table in which a color deviation amount of each color image detected by the color deviation detection sensor 63 and an exposure start timing or an exposure start position of the exposing device 5 are associated with each other.

The control unit 90 has functions, including a function of receiving output signals from the image density sensor 61 and the color deviation detection sensor 63 when the calibration mode is set, so as to calculate the toner adhesion amount and the color deviation amount based on the toner adhesion amount data and the color deviation data stored in the RAM 93 (or the ROM 92), a function of determining density of the datum image based on the calculated toner adhesion amount and comparing the density with a predetermined standard density so as to adjust at least one of image forming conditions of the image forming portions Pa to Pd for density correction of each color, and a function of adjusting image forming timings of the image forming portions Pa to Pd based on the calculated color deviation amounts so as to correct color deviations. Note that the calibration mode is automatically set when the image forming process of a predetermined number of sheets is finished.

The temporary storage portion 94 temporarily stores the image signal that is received by the image input portion 60 for receiving image data from the personal computer or the like and is converted into a digital signal. The counter 95 accumulates and counts the number of printed sheets.

As described above, the toner that deposits on the toner receiver member 37 is scattering toner floating in the developing container 20, and is deteriorated toner in which external additive is dropped or invested, or unstable toner for electrification having toner grain diameters deviated from an average grain diameter. Therefore, if the calibration mode is executed just after the deposited toner is shaken off by vibration of the toner receiver member 37 and is collected into the developing container 20, the parameter values used for density correction may be adjusted in a state different from a normal developing property. Thus, there is a problem that the image density is deviated from a target value when the normal developing property is restored after the toner collected in the toner collecting mode is discharged in the forced discharge mode.

In addition, the toner concentration in the developer and the charged amount of the toner are not uniform, and hence the datum image formed when the calibration is performed becomes unstable resulting in deteriorated accuracy of the calibration. As a result, image quality just after the calibration may be deteriorated.

In particular, when executing the calibration mode by adjusting toner concentrations in the developing devices 3*a* to 3*d*, the toner collected in the toner collecting mode has a large influence, and hence accuracy of calibration is easily deteriorated.

Accordingly, in the color printer 100 of the present disclosure, when the execution timing of calibration comes, the calibration mode is executed only if the number of printed sheets has reached a predetermined number after the last toner collecting mode and forced discharge mode were executed.

Figure 18:
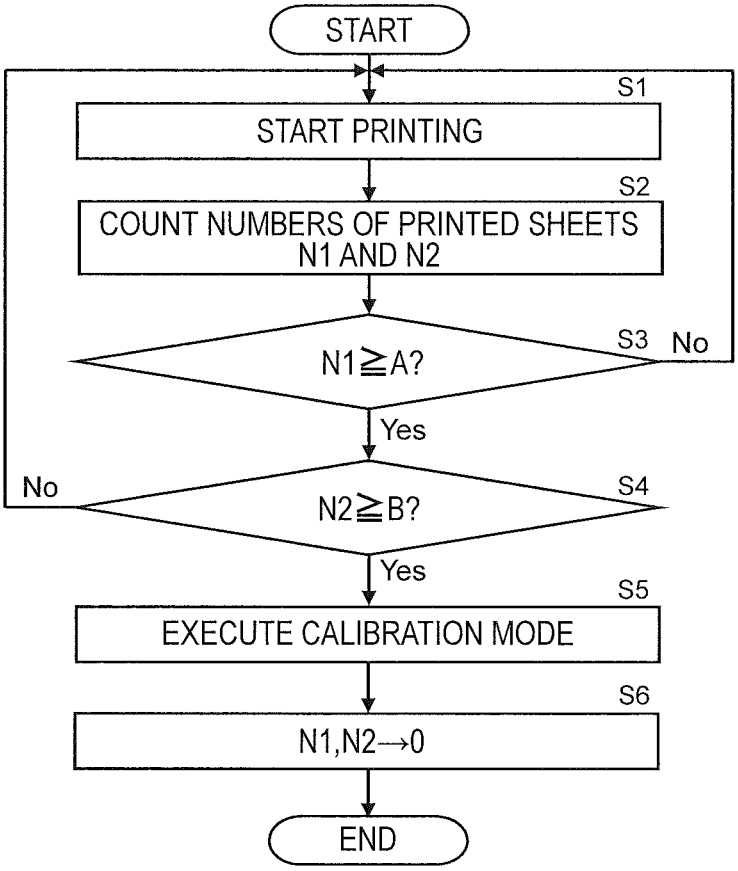
FIG. 18 is a flowchart showing a control example when the color printer executes a calibration mode.

FIG. 18 is a flowchart of a control example when the color printer 100 executes the calibration mode. With reference to FIGS. 1 to 17 if necessary, an execution procedure of the calibration is described along with steps of FIG. 18.

When a printing operation is started after a print instruction is received from the personal computer (Step S1), the control unit 90 controls the counter 95 to count the number of printed sheets N1 after the last execution of the calibration mode, and the number of printed sheets N2 after the last execution of the toner collecting mode and the forced discharge mode (Step S2).

Next, the control unit 90 determines whether or not the number of printed sheets N1 has become a threshold value A (e.g. 2000) or larger (Step S3). If the number of printed sheets N1 is less than the threshold value A (No in Step S3), the process returns to Step S1 so that the printing operation and the counting of the numbers of printed sheets N1 and N2 are repeated. If the number of printed sheets N1 is the threshold value A or more, (Yes in Step S3), it is determined whether or not the number of printed sheets N2 has become a threshold value B (e.g. 50) or more (Step S4).

If the number of printed sheets N2 is less than the threshold value B (No in Step S4), the process returns to Step S1 so that the printing operation, the counting of the numbers of printed sheets N1 and N2, and the determination whether or not the number of printed sheets N1 is the threshold value A or more are repeated. If the number of printed sheets N2 is the threshold value B or more (Yes in Step S4), the calibration mode is executed (Step S5).

When the calibration mode is executed, the image forming portions Pa to Pd form datum images for density correction and color deviation correction on the photosensitive drums 1*a* to 1*d*. The datum images are transferred onto the intermediate transfer belt 8 at predetermined positions by the primary transfer rollers 6*a* to 6*d*.

Next, the image density sensor 61 detects the toner adhesion amount (toner density) of the datum image for density correction. The detected toner density is compared with the standard density by the control unit 90, and an average value of density differences between each toner density and the standard density is calculated. In addition, the color deviation detection sensor 63 detects a positional relationship among the datum images for color deviation correction. The detected positional relationship is compared with the reference position by the control unit 90, and the color deviation amount of each color is calculated.

Further, the parameter value to be used for density correction corresponding to the obtained average value of the density differences is read out from the density correction table in the RAM 93 (or the ROM 92), and the control unit 90 transmits the control signal to change the parameter value so as to perform the density correction. In addition, in accordance with the color deviation mount of each color, a parameter value to be used for color deviation is read out from the color deviation correction table in the RAM 93 (or the ROM 92), and the control unit 90 adjusts the exposure start position or the exposure start timing of the exposing device 5 so that color deviation is corrected for each color. After that, the belt cleaner 19 removes the datum images on the intermediate transfer belt 8, and the calibration is finished.

After the calibration mode is finished, the numbers of printed sheets N1 and N2 are reset (Step S6), and the process is finished.

According to the control shown in FIG. 18, the calibration mode is executed only if the number of printed sheets after the last execution of the toner collecting mode and the forced discharge mode is a predetermined number (threshold value B) or more. As a result, execution of the calibration mode is restricted in the state where the toner has unstable charged amount just after the toner deposited on the toner receiver member 37 is collected into the developing container 20, and hence it is possible to suppress a malfunction that the image density is deviated from a target value when the toner collected in the forced discharge mode is discharged and the normal developing property is restored. In addition, the datum image formed when the calibration is performed is stabilized, and hence accuracy of calibration can be improved.

In addition, the toner collected into the developing container 20 in the toner collecting mode is discharged to outside of the developing container 20 in the forced discharge mode, the developers in the developing devices 3*a* to 3*d* can be quickly restored from the state where the toner has unstable charged amount to the original state. Therefore, image quality before the calibration mode is executed can be maintained. In addition, the threshold value B of the number of printed sheets N2 after execution of the toner collecting mode until execution of the calibration mode can be reduced, and hence a delay of the execution timing of the calibration mode can be reduced as much as possible.

Other than that, the present disclosure is not limited to the embodiments described above, and it can be variously modified within the scope of the present disclosure without deviating from the spirit thereof. For instance, the shapes and structures of the toner receiver support member 35 and the toner receiver member 37 shown in the individual embodiments are merely examples, which are not particularly limited to those in the embodiment. These can be appropriately set in accordance with the structure or the like of the developing devices 3*a* to 3*d*. Effects of the present disclosure are further described in detail using Examples below.

Example 1

In the developing devices 3*a* to 3*d* of the second embodiment illustrated in FIG. 12, the stirring and conveying screw 25 was stopped, and only the feed conveying screw 26 was rotated. Then, it was checked whether or not developer was discharged from the first developer discharging portion 20*j*. Note that the test was performed using the cyan image forming portion Pa including the photosensitive drum 1*a* and the developing device 3*a*.

As conditions of the test apparatus, a process line speed was set to 160 mm/sec, a diameter of the photosensitive drum 1*a* was 30 mm, diameters of the toner supply roller 30 and the developing roller 31 were both 16 mm, and a line speed ratio (S/D) of the developing roller 31 to the photosensitive drum 1*a* was set to 1.8. In addition, a ratio (T/C) between toner and carrier in developer was set to 10%.

The first helical blade 25*a* of the stirring and conveying screw 25 has an outer diameter of 13 mm and a pitch of 30 mm, the second helical blade 26*a* of the feed conveying screw 26 has an outer diameter of 13 mm and a pitch of 30 mm. In addition, the restricting portion 52 is constituted of two reverse winding (opposite phase) helical blades having an outer diameter of 12 mm and a pitch of 5 mm, and a space between the restricting portion 52 and the feed conveying chamber 20*c* is 1.5 mm. The discharging blade 53 is a helical blade having an outer diameter of 8 mm and a pitch of 5 mm, and a space between the discharging blade 53 and the first developer discharging portion 20*j* is 1 mm.

Then, the discharging manner of the developer from the first developer discharging portion 20*j* was checked in individual states, including a state where the stirring and conveying screw 25 and the feed conveying screw 26 were rotated at a rotational frequency of 330 rpm so that the developer was circulated and conveyed, and a state where only the stirring and conveying screw 25 was stopped.

As a result of the test, discharging of the developer from the first developer discharging portion 20*j* was not observed in the state where both the stirring and conveying screw 25 and the feed conveying screw 26 were rotated. In contrast, in the state where only the stirring and conveying screw 25 was stopped, retention of developer occurred on the downstream side of the feed conveying chamber 20*c* in the developer conveying direction, and discharging of the developer from the first developer discharging portion 20*j* was observed. From this result, it was confirmed that the developer containing collected toner can be discharged by executing the forced discharge mode in which only the stirring and conveying screw 25 is stopped after the toner collecting mode is executed.

Example 2

In the developing devices 3*a* to 3*d* of the third embodiment illustrated in FIGS. 14 and 15, it was checked whether or not developer was discharged from the second developer discharging portion 20*k* when the stirring and conveying screw 25 was stopped while only the feed conveying screw 26 was rotated. Note that the test was performed in the cyan image forming portion Pa containing the photosensitive drum 1*a* and the developing device 3*a*.

Conditions of the test and structures of the first helical blade 25*a* of the stirring and conveying screw 25, the second helical blade 26*a* of the feed conveying screw 26, and the restricting portion 52 were the same as those in the second embodiment. A structure of the second developer discharging portion 20*k* was the same as the first developer discharging portion 20*j*. Further, discharging of the developer from the second developer discharging portion 20*k* was checked in individual states, including a state where the stirring and conveying screw 25 and the feed conveying screw 26 were forwardly rotated at a rotational frequency of 330 rpm so that the developer was circulated and conveyed, and a state where the stirring and conveying screw 25 and the feed conveying screw 26 were reversely rotated at a rotational frequency of 330 rpm.

As a result of the test, discharging of the developer from the second developer discharging portion 20*k* was not observed in the state where the stirring and conveying screw 25 and the feed conveying screw 26 were forwardly rotated in the image formation period. In contrast, in the state where the stirring and conveying screw 25 and the feed conveying screw 26 were reversely rotated, a flow of developer occurred toward the second developer discharging portion 20*k*, and discharging of the developer from the second developer discharging portion 20*k* was observed. From this result, it was confirmed that the developer containing collected toner can be discharged by executing the forced discharge mode in which the stirring and conveying screw 25 and the feed conveying screw 26 are reversely rotated after the toner collecting mode is executed.

The present disclosure can be applied to developing devices that can execute the toner collecting mode in which toner deposited in the periphery of the regulating blade is collected into the casing. Applying the present disclosure, it is possible to provide a developing device that can efficiently discharge the developer containing toner collected into the casing, and that can effectively suppress a fogged image and scattering of toner due to electrification error of toner in the developer.

What is claimed is:

1. A developing device comprising:

a developing container including a first conveying chamber, a second conveying chamber disposed in parallel to the first conveying chamber with a partition portion therebetween, and communicating portions for communicating the first conveying chamber and the second conveying chamber at both end portion sides of the partition portion in its longitudinal direction, the developing container storing two-component developer containing carrier and toner;

a first stirring and conveying member configured to stir and convey the developer in the first conveying chamber in its rotation shaft direction;

a second stirring and conveying member configured to stir and convey the developer in the second conveying chamber in a direction opposite to the first stirring and conveying member;

a developer replenishing port for replenishing the developing container with the developer;

a developer discharging portion configured to discharge excess developer from the developing container;

a developing roller supported by the developing container in a rotatable manner, so as to supply toner to an image carrier on which an electrostatic latent image is formed, in an opposed region between the developing roller and the image carrier;

a toner supply roller supported by the developing container in a rotatable manner, so as to carry the developer in the second conveying chamber on its surface and to supply the toner to the developing roller in an opposed region between the toner supply roller and the developing roller;

a regulating blade disposed to face the toner supply roller with a predetermined space therebetween;

a toner receiver member disposed to face the developing roller or the toner supply roller between the regulating blade and the image carrier in the developing container, so as to receive the toner dropped from the developing roller; and a vibration generating device configured to vibrate the toner receiver member, wherein the developing device is capable of executing a toner collecting mode in which the vibration generating device vibrates the toner receiver member so that the toner deposited on the toner receiver member is shaken off by vibration and is collected into the second conveying chamber, in a non-image formation period, and the developing device is capable of executing a forced discharge mode in which the developer containing the collected toner collected from the toner receiver member into the second conveying chamber is forcibly discharged from the developer discharging portion to outside of the developing container, after the toner collecting mode is executed.

2. The developing device according to claim 1, wherein the developer discharging portion is disposed on a side surface of the first conveying chamber, the side surface being parallel to a developer conveying direction in the first conveying chamber, the developing device includes a convey amount adjusting portion disposed at a part of the first stirring and conveying member, the part facing the developer discharging portion, the convey amount adjusting portion reducing the conveying amount of the developer to be smaller when the first stirring and conveying member is reversely rotated than when the first stirring and conveying member is forwardly rotated, and the developing device executes the forced discharge mode by reversely rotating the first stirring and conveying member and the second stirring and conveying member so that retention of developer occurs at the convey amount adjusting portion.

3. The developing device according to claim 2, wherein the first stirring and conveying member includes a rotation shaft and a helical blade formed on an outer circumferential surface of the rotation shaft, and the helical blade constituting the convey amount adjusting portion has a smaller inclination angle of the conveying surface of the helical blade with respect to the rotation shaft in reverse rotation of the first stirring and conveying member than other parts.

4. The developing device according to claim 2, wherein execution time of the forced discharge mode is more than or equal to conveying time of the developer from an upstream side end portion of the toner supply roller in the developer conveying direction when the forced discharge mode is executed to the developer discharging portion.

5. The developing device according to claim 1, wherein the developer discharging portion is a first developer discharging portion disposed at a downstream side end portion of the second conveying chamber in a developer conveying direction in the second conveying chamber, and after the toner collecting mode is executed, a rotation speed of the first stirring and conveying member is set to be lower than a rotation speed of the second stirring and conveying member, so that the forced discharge mode is executed.

6. The developing device according to claim 5, wherein execution time of the forced discharge mode is more than or equal to conveying time of the developer from an upstream side end portion of the toner supply roller in the developer conveying direction when the forced discharge mode is executed to the first developer discharging portion.

7. The developing device according to claim 1, wherein the developer discharging portion includes a first developer discharging portion disposed at a downstream side end portion of the second conveying chamber in a developer conveying direction in the second conveying chamber, and a second developer discharging portion disposed on the side surface of the developing container to be perpendicular to the developer conveying direction in the developing container when the first stirring and conveying member and the second stirring and conveying member are forwardly rotated on the upstream side, and the first stirring and conveying member and the second stirring and conveying member are reversely rotated so that the forced discharge mode is executed after the toner collecting mode is executed.

8. The developing device according to claim 7, wherein the second developer discharging portion is disposed on the side surface of the first conveying chamber at a position facing the communicating portion for passing the developer from the first conveying chamber to the second conveying chamber when the first stirring and conveying member and the second stirring and conveying member are forwardly rotated.

9. The developing device according to claim 7, wherein execution time of the forced discharge mode is more than or equal to conveying time of the developer from an upstream side end portion of the toner supply roller in the developer conveying direction when the forced discharge mode is executed to the second developer discharging portion.

10. The developing device according to claim 1, wherein the toner supply roller is rotated in a direction opposite to an image formation period when the toner collecting mode is executed.

11. An image forming apparatus comprising an image forming portion including:

an image carrier;

an exposing device configured to form an electrostatic latent image on the image carrier; and the developing device according to claim 1, the developing device developing the electrostatic latent image formed by the exposing device.

12. The image forming apparatus according to claim 11, further comprising:

an image density sensor for detecting density of a datum image formed by the image forming portion;

a control unit capable of executing a calibration mode in which density correction is performed based on a result of the detection by the image density sensor; and a printed sheet number counting portion configured to separately count the number of printed sheets N1 after the last execution of the calibration mode and the number of printed sheets N2 after the last execution of the toner collecting mode and the forced discharge mode, wherein the control unit executes the calibration mode if the number of printed sheets N1 counted by the printed sheet number counting portion is a predetermined number or more and if the number of printed sheets N2 is a predetermined number or more.

13. The image forming apparatus according to claim 12, wherein the control unit executes the calibration mode by adjusting toner concentration in the developing device based on a result of the detection by the image density sensor.

* * * * *